US009711166B2

(12) United States Patent
Qutub et al.

(10) Patent No.: US 9,711,166 B2
(45) Date of Patent: Jul. 18, 2017

(54) DECIMATION SYNCHRONIZATION IN A MICROPHONE

(71) Applicant: Knowles Electronics, LLC, Itasca, IL (US)

(72) Inventors: Sarmad Qutub, DesPlaines, IL (US); Robert A. Popper, Lemont, IL (US); Thibault Kassir, Chicago, IL (US); Dibyendu Nandy, Naperville, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/533,690

(22) Filed: Nov. 5, 2014

(65) Prior Publication Data

US 2015/0055803 A1 Feb. 26, 2015

Related U.S. Application Data

(63) Continuation-in-part of application No. 14/282,101, filed on May 20, 2014.

(Continued)

(51) Int. Cl.
*H04R 3/00* (2006.01)
*G10L 25/48* (2013.01)

(52) U.S. Cl.
CPC ..... *G10L 25/48* (2013.01); *H04R 3/00* (2013.01); *H04R 2410/00* (2013.01); *H04R 2499/11* (2013.01)

(58) Field of Classification Search
CPC . H04R 3/00; H04R 1/08; H04R 17/02; H04R 19/005; H04R 19/04;

(Continued)

(56) References Cited

U.S. PATENT DOCUMENTS 4,052,568 A 10/1977 Jankowski
5,577,164 A 11/1996 Kaneko (Continued)

FOREIGN PATENT DOCUMENTS

JP 2001236095 A 8/2001
JP 2004219728 8/2004

(Continued)

OTHER PUBLICATIONS

International Search Report for PCT/EP2014/038790, dated Sep. 23, 2014, 9 pages.

(Continued)

*Primary Examiner* — Davetta W Goins
*Assistant Examiner* — Daniel Sellers
(74) *Attorney, Agent, or Firm* — Foley & Lardner LLP

(57) ABSTRACT

An external clock signal having a first frequency is received. A division ratio is automatically determined based at least in part upon a second frequency of an internal clock. The second frequency is greater than the first frequency. A decimation factor is automatically determined based at least in part upon the first frequency of the external clock signal, the second frequency of the internal clock signal, and a predetermined desired sampling frequency. The division ratio is applied to the internal clock signal to reduce the first frequency to a reduced third frequency. The decimation factor is applied to the reduced third frequency to provide the predetermined desired sampling frequency. Data is clocked to a buffer using the predetermined desired sampling frequency.

23 Claims, 7 Drawing Sheets

Related U.S. Application Data

(60) Provisional application No. 61/901,832, filed on Nov. 8, 2013, provisional application No. 61/826,587, filed on May 23, 2013.

(58) Field of Classification Search
CPC H04R 2201/003; H04R 23/00; H04R 23/006; H04R 2410/00; H04R 2499/11; G10L 25/48; G10L 15/00; G10L 25/78
USPC ..... 381/174, 175; 257/415, 416
See application file for complete search history.

(56) References Cited

U.S. PATENT DOCUMENTS 5,598,447 A * 1/1997 Usui ..... H01L 27/0207 326/81
5,675,808 A * 10/1997 Gulick et al. ..... 713/322
5,822,598 A 10/1998 Lam
5,983,186 A 11/1999 Miyazawa
6,049,565 A 4/2000 Paradine
6,057,791 A * 5/2000 Knapp ..... G06F 3/05 341/122
6,070,140 A 5/2000 Tran
6,154,721 A 11/2000 Sonnic
6,249,757 B1 6/2001 Cason
6,259,291 B1 * 7/2001 Huang ..... G06F 1/08 327/115
6,282,268 B1 8/2001 Hughes
6,324,514 B2 11/2001 Matulich
6,397,186 B1 5/2002 Bush
6,453,020 B1 9/2002 Hughes
6,564,330 B1 5/2003 Martinez
6,591,234 B1 7/2003 Chandran
6,640,208 B1 10/2003 Zhang
6,756,700 B2 6/2004 Zeng
6,829,244 B1 12/2004 Wildfeuer et al.
7,190,038 B2 3/2007 Dehe
7,415,416 B2 8/2008 Rees
7,473,572 B2 1/2009 Dehe
7,619,551 B1 * 11/2009 Wu ..... 341/143
7,630,504 B2 * 12/2009 Poulsen ..... H03M 7/3015 341/143
7,774,202 B2 8/2010 Spengler
7,774,204 B2 8/2010 Mozer
7,781,249 B2 8/2010 Laming
7,795,695 B2 9/2010 Weigold
7,825,484 B2 11/2010 Martin
7,829,961 B2 11/2010 Hsiao
7,856,283 B2 * 12/2010 Burk et al. ..... 700/94
7,856,804 B2 12/2010 Laming
7,903,831 B2 3/2011 Song
7,936,293 B2 5/2011 Hamashita
7,941,313 B2 5/2011 Garudadri
7,957,972 B2 6/2011 Huang
7,994,947 B1 * 8/2011 Ledzius ..... 341/61
8,171,322 B2 5/2012 Fiennes
8,208,621 B1 6/2012 Hsu
8,275,148 B2 9/2012 Li
8,331,581 B2 12/2012 Pennock
8,666,751 B2 3/2014 Murthi
8,687,823 B2 4/2014 Loeppert
8,731,210 B2 5/2014 Cheng
8,798,289 B1 8/2014 Every
8,804,974 B1 8/2014 Melanson
8,849,231 B1 9/2014 Murgia
8,972,252 B2 3/2015 Hung
8,996,381 B2 3/2015 Mozer
9,020,819 B2 4/2015 Saitoh
9,043,211 B2 5/2015 Haiut
9,059,630 B2 6/2015 Gueorguiev
9,073,747 B2 7/2015 Ye
9,076,447 B2 7/2015 Nandy
9,111,548 B2 8/2015 Nandy
9,112,984 B2 8/2015 Sejnoha
9,113,263 B2 8/2015 Furst
9,119,150 B1 8/2015 Murgia
9,142,215 B2 9/2015 Rosner
9,147,397 B2 9/2015 Thomsen
9,161,112 B2 10/2015 Ye
2002/0054588 A1 5/2002 Mehta
2002/0116186 A1 8/2002 Strauss
2002/0123893 A1 9/2002 Woodward
2002/0184015 A1 12/2002 Li
2003/0004720 A1 1/2003 Garudadri
2003/0061036 A1 3/2003 Garudadri
2003/0138061 A1 7/2003 Li
2003/0144844 A1 7/2003 Colmenarez
2004/0022379 A1 2/2004 Klos
2005/0207605 A1 9/2005 Dehe
2006/0074658 A1 4/2006 Chadha
2006/0233389 A1 10/2006 Mao et al.
2006/0247923 A1 11/2006 Chandran
2007/0127761 A1 6/2007 Poulsen
2007/0168908 A1 7/2007 Paolucci
2007/0274297 A1 11/2007 Cross et al.
2007/0278501 A1 12/2007 MacPherson
2008/0089536 A1 4/2008 Josefsson
2008/0175425 A1 7/2008 Roberts
2008/0201138 A1 8/2008 Visser
2008/0267431 A1 10/2008 Leidl
2008/0279407 A1 11/2008 Pahl
2008/0283942 A1 11/2008 Huang
2009/0001553 A1 1/2009 Pahl
2009/0003629 A1 * 1/2009 Shajaan ..... H04R 1/005 381/113
2009/0180655 A1 7/2009 Tien
2009/0234645 A1 9/2009 Bruhn
2010/0046780 A1 2/2010 Song
2010/0052082 A1 3/2010 Lee
2010/0057474 A1 3/2010 Kong
2010/0128894 A1 5/2010 Petit
2010/0128914 A1 5/2010 Khenkin
2010/0131783 A1 5/2010 Weng
2010/0183181 A1 7/2010 Wang
2010/0246877 A1 9/2010 Wang
2010/0290644 A1 11/2010 Wu
2010/0292987 A1 11/2010 Kawaguchi
2010/0322443 A1 12/2010 Wu
2010/0322451 A1 12/2010 Wu
2011/0007907 A1 1/2011 Park
2011/0013787 A1 1/2011 Chang
2011/0029109 A1 * 2/2011 Thomsen et al. ..... 700/94
2011/0075875 A1 3/2011 Wu
2011/0106533 A1 5/2011 Yu
2011/0208520 A1 8/2011 Lee
2011/0280109 A1 * 11/2011 Raymond ..... G04G 7/005 368/46
2012/0010890 A1 1/2012 Koverzin
2012/0112804 A1 * 5/2012 Li ..... H03L 7/00 327/142
2012/0232896 A1 9/2012 Taleb
2012/0250881 A1 10/2012 Mulligan
2012/0250910 A1 10/2012 Shajaan et al.
2012/0310641 A1 12/2012 Niemisto
2013/0035777 A1 2/2013 Niemisto et al.
2013/0044898 A1 2/2013 Schultz
2013/0058495 A1 3/2013 Furst et al.
2013/0058506 A1 3/2013 Boor
2013/0223635 A1 8/2013 Singer
2013/0226324 A1 8/2013 Hannuksela
2013/0246071 A1 9/2013 Lee
2013/0322461 A1 * 12/2013 Poulsen ..... 370/458
2013/0343584 A1 12/2013 Bennett et al.
2014/0064523 A1 3/2014 Kropfitsch
2014/0122078 A1 5/2014 Joshi
2014/0143545 A1 5/2014 McKeeman
2014/0163978 A1 6/2014 Basye
2014/0177113 A1 6/2014 Gueorguiev
2014/0188467 A1 7/2014 Jing
2014/0188470 A1 7/2014 Chang
2014/0197887 A1 7/2014 Hovesten
2014/0244269 A1 8/2014 Tokutake
2014/0244273 A1 * 8/2014 Laroche ..... G06F 1/3206 704/275

(56) References Cited

U.S. PATENT DOCUMENTS

| | | | |
|---|---|---|---|
| 2014/0249820 | A1 | 9/2014 | Hsu |
| 2014/0257813 | A1 | 9/2014 | Mortensen |
| 2014/0257821 | A1 | 9/2014 | Adams |
| 2014/0274203 | A1 | 9/2014 | Ganong |
| 2014/0278435 | A1 | 9/2014 | Ganong et al. |
| 2014/0281628 | A1 | 9/2014 | Nigam |
| 2014/0343949 | A1 | 11/2014 | Huang |
| 2014/0348345 | A1 | 11/2014 | Furst |
| 2014/0358552 | A1 | 12/2014 | Xu |
| 2015/0039303 | A1 | 2/2015 | Lesso |
| 2015/0043755 | A1 | 2/2015 | Furst |
| 2015/0046157 | A1 | 2/2015 | Wolff |
| 2015/0046162 | A1 | 2/2015 | Aley-Raz |
| 2015/0049884 | A1 | 2/2015 | Ye |
| 2015/0055803 | A1 | 2/2015 | Qutub |
| 2015/0058001 | A1 | 2/2015 | Dai |
| 2015/0063594 | A1 | 3/2015 | Nielsen |
| 2015/0073780 | A1 | 3/2015 | Sharma |
| 2015/0073785 | A1 | 3/2015 | Sharma |
| 2015/0088500 | A1 | 3/2015 | Conliffe |
| 2015/0106085 | A1 | 4/2015 | Lindahl |
| 2015/0110290 | A1 | 4/2015 | Furst |
| 2015/0112690 | A1 | 4/2015 | Guha |
| 2015/0134331 | A1 | 5/2015 | Millet |
| 2015/0154981 | A1 | 6/2015 | Barreda |
| 2015/0161989 | A1 | 6/2015 | Hsu |
| 2015/0195656 | A1 | 7/2015 | Ye |
| 2015/0206527 | A1 | 7/2015 | Connolly |
| 2015/0256660 | A1 | 9/2015 | Kaller |
| 2015/0256916 | A1 | 9/2015 | Volk |
| 2015/0287401 | A1 | 10/2015 | Lee |
| 2015/0302865 | A1 | 10/2015 | Pilli |
| 2015/0304502 | A1 | 10/2015 | Pilli |
| 2015/0350760 | A1 | 12/2015 | Nandy |
| 2015/0350774 | A1 | 12/2015 | Furst |
| 2016/0012007 | A1 | 1/2016 | Popper |
| 2016/0087596 | A1 | 3/2016 | Yurrtas |
| 2016/0133271 | A1 | 5/2016 | Kuntzman |
| 2016/0134975 | A1 | 5/2016 | Kuntzman |

FOREIGN PATENT DOCUMENTS

| | | |
|---|---|---|
| WO | 2009130591 | 10/2009 |
| WO | 2011106065 | 9/2011 |
| WO | 2011140096 | 11/2011 |
| WO | 2013049358 | 4/2013 |
| WO | 2013085499 | 6/2013 |

OTHER PUBLICATIONS

International Search Report and Written Opinion for PCT/EP2014/064324, dated Feb. 12, 2015 (13 pages).

"MEMS technologies: Microphone" EE Herald Jun. 20, 2013.

Delta-sigma modulation, Wikipedia (Jul. 4, 2013).

Pulse-density modulation, Wikipedia (May 3, 2013).

Kite, Understanding PDM Digital Audio, Audio Precision, Beaverton, OR, 2012.

International Search Report and Written Opinion for PCT/US2014/060567 dated Jan. 16, 2015 (12 pages).

International Search Report and Written Opinion for PCT/US2014/062861 dated Jan. 23, 2015 (12 pages).

International Search Report and Written Opinion for PCT/US2016/013859 dated Apr. 29, 2016 (12 pages).

Search Report of Taiwan Patent Application No. 103135811, dated Apr. 18, 2016 (1 page).

* cited by examiner

| Transition | Requirements | Transition | Requirements |
|---|---|---|---|
| A1 | Apply Vdd<br>No clock on clock input pin | A1' | Remove Vdd |
| A2 | Apply Vdd<br>Apply 512kHz clock to clock imput pin | A2' | Remove Vdd |
| B1 | Acoustic Event Trigger | B1' | No Acoustic Activity for OTP programmed amount of time |
| B2 | Acoustic Event Trigger | B2' | No Acoustic Activity for OTP programmed amount of time |
| C | NO PATH IN THIS DIRECTION, BUFFER IS NOT VALID<br>MUST Go through E1' or E2' | C' | Clock Detected on Clock Pin > 1MHz |
| D | Remove Vdd | D' | Apply Vdd<br>Clock Input > 1MHz |
| E1 | Clock Detected > 1MHz | E1' | No Clock on Clock pin |
| E2 | Clock Detected > 1MHz | E2' | Clock Detected at 512kHz |
| E3 | Clock Detected at 512kHz | E3' | No Clock on Clock pin |

*FIG. 5*

DECIMATION SYNCHRONIZATION IN A MICROPHONE

CROSS REFERENCE TO RELATED APPLICATION

This patent claims benefit under 35 U.S.C. §119 (e) to U.S. Provisional Application No. 61/901,832 entitled "Microphone and Corresponding Digital Interface" filed Nov. 8, 2013, the content of which is incorporated herein by reference in its entirety. This patent is a continuation-in-part of U.S. application Ser. No. 14/282,101 entitled "VAD Detection Microphone and Method of Operating the Same" filed May 20, 2014, which claims priority to U.S. Provisional Application No. 61/826,587 entitled "VAD Detection Microphone and Method of Operating the Same" filed May 23, 2013, the content of both is incorporated by reference in its entirety.

TECHNICAL FIELD

This application relates to acoustic activity detection (AAD) approaches and voice activity detection (VAD) approaches, and their interfacing with other types of electronic devices.

BACKGROUND OF THE INVENTION

Voice activity detection (VAD) approaches are important components of speech recognition software and hardware. For example, recognition software constantly scans the audio signal of a microphone searching for voice activity, usually, with a MIPS intensive algorithm. Since the algorithm is constantly running, the power used in this voice detection approach is significant.

Microphones are also disposed in mobile device products such as cellular phones. These customer devices have a standardized interface. If the microphone is not compatible with this interface it cannot be used with the mobile device product.

Many mobile devices products have speech recognition included with the mobile device. However, the power usage of the algorithms are taxing enough to the battery that the feature is often enabled only after the user presses a button or wakes up the device. In order to enable this feature at all times, the power consumption of the overall solution must be small enough to have minimal impact on the total battery life of the device. As mentioned, this has not occurred with existing devices.

Because of the above-mentioned problems, some user dissatisfaction with previous approaches has occurred.

BRIEF DESCRIPTION OF THE DRAWINGS

For a more complete understanding of the disclosure, reference should be made to the following detailed description and accompanying drawings wherein:

FIG. 5 comprises a table showing the conditions for transitions between the states shown in the state diagram of FIG. 4 according to various embodiments of the present invention;

Figure 1A:
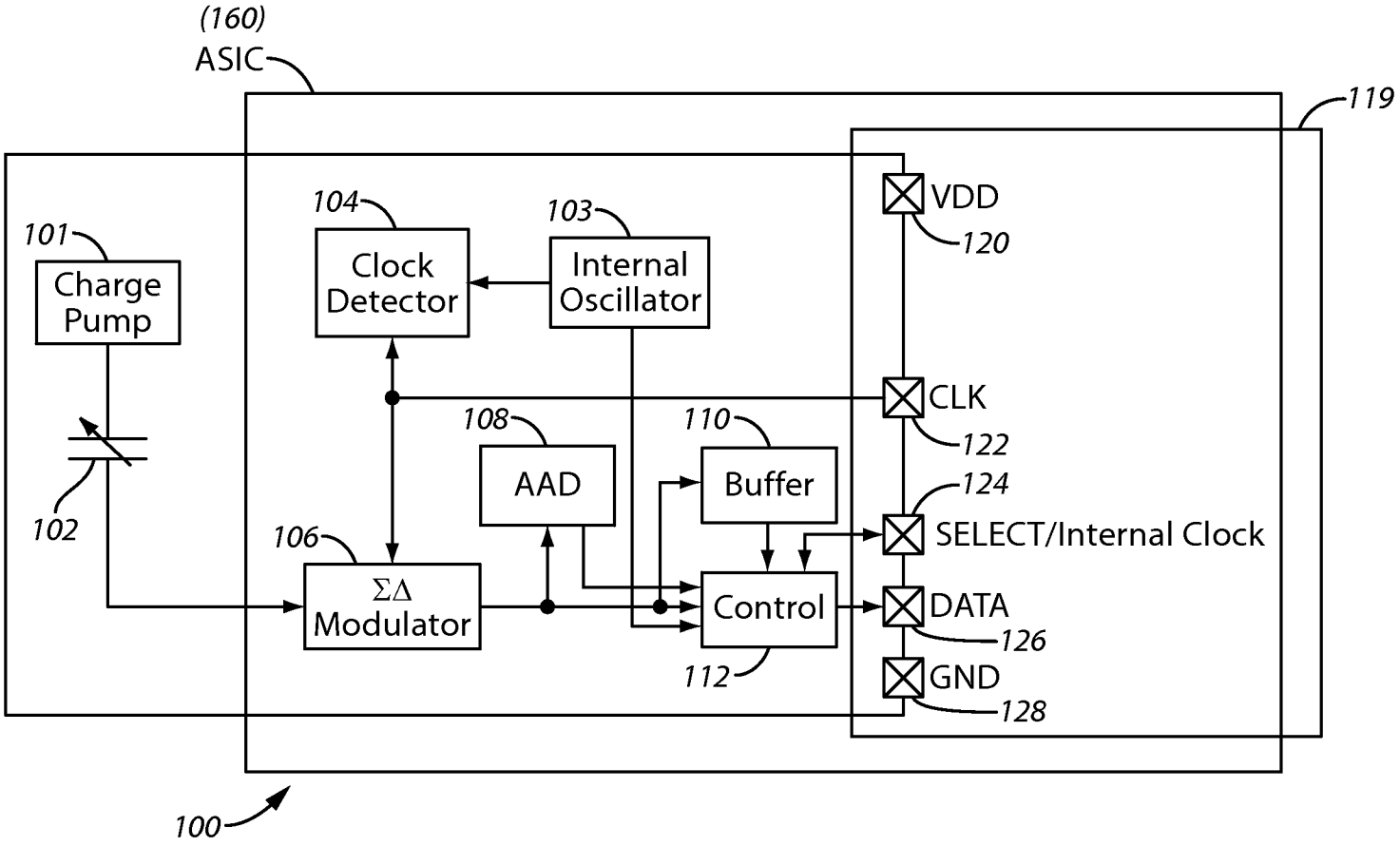
FIG. 1A comprises a block diagram of an acoustic system with acoustic activity detection (AAD) according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Approaches are described herein that integrate voice activity detection (VAD) or acoustic activity detection (AAD) approaches into microphones. At least some of the microphone components (e.g., VAD or AAD modules) are disposed at or on an application specific circuit (ASIC) or other integrated device. The integration of components such as the VAD or AAD modules significantly reduces the power requirements of the system thereby increasing user satisfaction with the system. An interface is also provided between the microphone and circuitry in an electronic device (e.g., cellular phone or personal computer) in which the microphone is disposed. The interface is standardized so that its configuration allows placement of the microphone in most if not all electronic devices (e.g. cellular phones). The microphone operates in multiple modes of operation including a lower power mode that still detects acoustic events such as voice signals.

In many of these embodiments, an external clock signal having a first frequency is received. An automatic determination is made for a division ratio based at least in part upon a second frequency of an internal clock, the second frequency being greater than the first frequency. A decimation factor is automatically determined based at least in part upon the first frequency of the external clock signal, the second frequency of the internal clock signal, and a predetermined desired sampling frequency. The division ratio is applied to the internal clock signal to reduce the first frequency to a reduced third frequency. The decimation factor is applied to the reduced third frequency to provide the predetermined desired sampling frequency. Data is clocked to a buffer using the predetermined desired sampling frequency.

In other aspects, the external clock signal is subsequently removed. In other examples, the predetermined desired sampling frequency comprises a frequency rate of approximately 16 kHz.

In others of these embodiments, and apparatus includes interface circuitry that has an input and output, and the input is configured to receive an external clock signal having a first frequency. The apparatus also includes processing circuitry, and the processing circuitry is coupled to the interface circuitry and configured to automatically determine a division ratio based at least in part upon a second frequency of an internal clock, the second frequency being greater than the first frequency. The processing circuitry is further configured to automatically determine a decimation factor based at least in part upon the first frequency of the external clock signal, the second frequency of the internal clock signal, and a predetermined desired sampling frequency. The processing circuitry is further configured to apply the division ratio to the internal clock signal to reduce the first frequency to a reduced third frequency and to apply the decimation factor to the reduced third frequency to provide the predetermined desired sampling frequency. The processing circuitry is further configured to clock data to a buffer via the output using the predetermined desired sampling frequency.

Referring now to FIG. 1A, a microphone apparatus 100 includes a charge pump 101, a capacitive microelectromechanical system (MEMS) sensor 102, a clock detector 104, a sigma-delta modulator 106, an acoustic activity detection (AAD) module 108, a buffer 110, and a control module 112. It will be appreciated that these elements may be implemented as various combinations of hardware and programmed software and at least some of these components can be disposed on an ASIC.

The charge pump 101 provides a voltage to charge up and bias a diaphragm of the capacitive MEMS sensor 102. For some applications (e.g., when using a piezoelectric device as a sensor), the charge pump may be replaced with a power supply that may be external to the microphone. A voice or other acoustic signal moves the diaphragm, the capacitance of the capacitive MEMS sensor 102 changes, and voltages are created that becomes an electrical signal. In one aspect, the charge pump 101 and the MEMS sensor 102 are not disposed on the ASIC (but in other aspects, they may be disposed on the ASIC). It will be appreciated that the MEMS sensor 102 may alternatively be a piezoelectric sensor, a speaker, or any other type of sensing device or arrangement.

The clock detector 104 controls which clock goes to the sigma-delta modulator 106 and synchronizes the digital section of the ASIC. If external clock is present, the clock detector 104 uses that clock; if no external clock signal is present, then the clock detector 104 use an internal oscillator 103 for data timing/clocking purposes.

The sigma-delta modulator 106 converts the analog signal into a digital signal. The output of the sigma-delta modulator 106 is a one-bit serial stream, in one aspect. Alternatively, the sigma-delta modulator 106 may be any type of analog-to-digital converter.

The buffer 110 stores data and constitutes a running storage of past data. By the time acoustic activity is detected, this past additional data is stored in the buffer 110. In other words, the buffer 110 stores a history of past audio activity. When an audio event happens (e.g., a trigger word is detected), the control module 112 instructs the buffer 110 to spool out data from the buffer 110. In one example, the buffer 110 stores the previous approximately 180 ms of data generated prior to the activity detect. Once the activity has been detected, the microphone 100 transmits the buffered data to the host (e.g., electronic circuitry in a customer device such as a cellular phone).

The acoustic activity detection (AAD) module 108 detects acoustic activity. Various approaches can be used to detect such events as the occurrence of a trigger word, trigger phrase, specific noise or sound, and so forth. In one aspect, the module 108 monitors the incoming acoustic signals looking for a voice-like signature (or monitors for other appropriate characteristics or thresholds). Upon detection of acoustic activity that meets the trigger requirements, the microphone 100 transmits a pulse density modulation (PDM) stream to wake up the rest of the system chain to complete the full voice recognition process. Other types of data could also be used.

The control module 112 controls when the data is transmitted from the buffer. As discussed elsewhere herein, when activity has been detected by the AAD module 108, then the data is clocked out over an interface 119 that includes a VDD pin 120, a clock pin 122, a select pin 124, a data pin 126 and a ground pin 128. The pins 120-128 form the interface 119 that is recognizable and compatible in operation with various types of electronic circuits, for example, those types of circuits that are used in cellular phones. In one aspect, the microphone 100 uses the interface 119 to communicate with circuitry inside a cellular phone. Since the interface 119 is standardized as between cellular phones, the microphone 100 can be placed or disposed in any phone that utilizes the standard interface. The interface 119 seamlessly connects to compatible circuitry in the cellular phone. Other interfaces are possible with other pin outs. Different pins could also be used for interrupts.

In operation, the microphone 100 operates in a variety of different modes and several states that cover these modes. For instance, when a clock signal (with a frequency falling within a predetermined range) is supplied to the microphone 100, the microphone 100 is operated in a standard operating mode. If the frequency is not within that range, the microphone 100 is operated within a sensing mode. In the sensing mode, the internal oscillator 103 of the microphone 100 is being used and, upon detection of an acoustic event, data transmissions are aligned with the rising clock edge, where the clock is the internal clock.

Figure 1B:
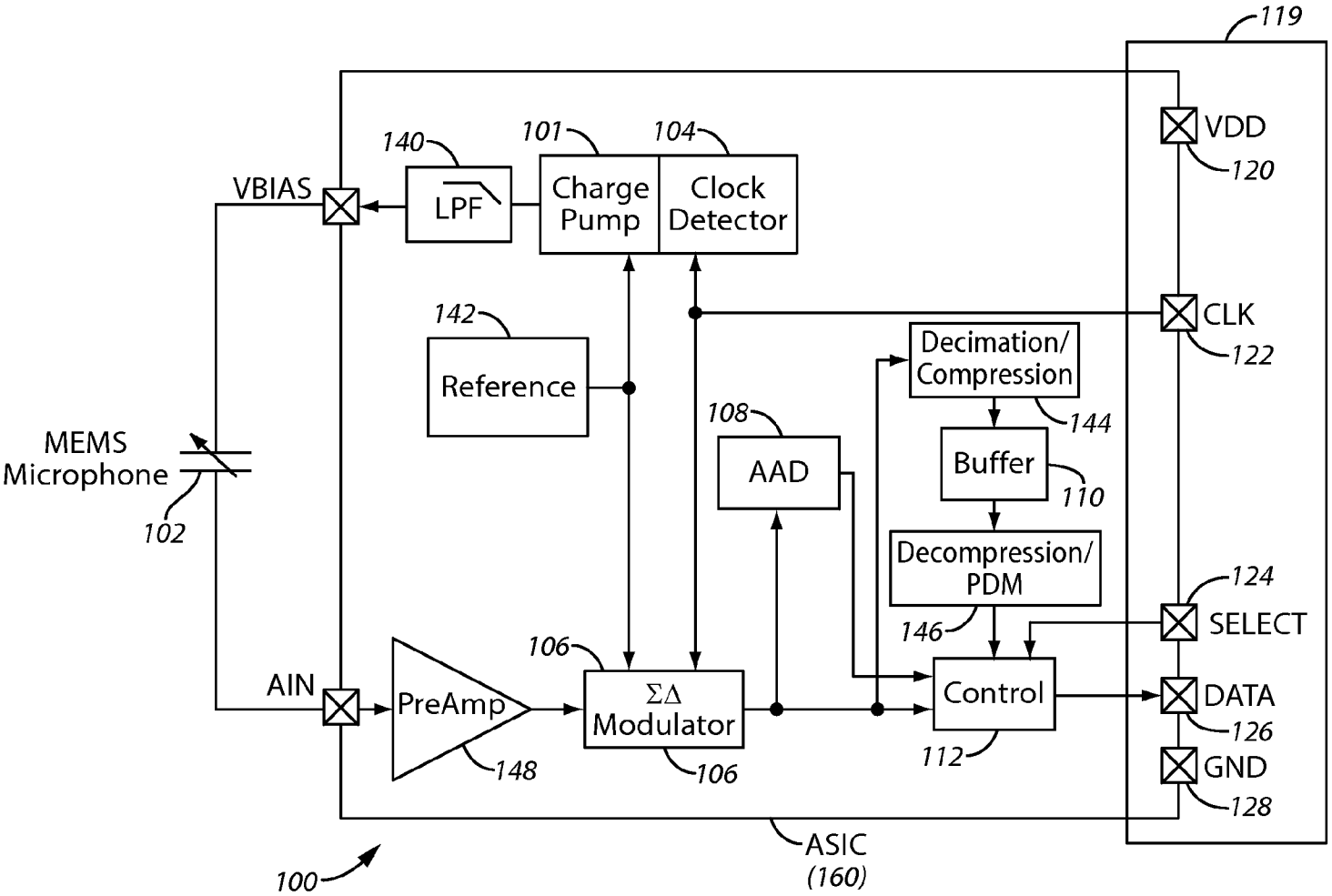
FIG. 1B comprises a block diagram of another acoustic system with acoustic activity detection (AAD) according to various embodiments of the present invention.

Referring now to FIG. 1B, another example of a microphone 100 is described. This example includes the same elements as those shown in FIG. 1A and these elements are numbered using the same labels as those shown in FIG. 1A.

In addition, the microphone 100 of FIG. 1B includes a low pass filter 140, a reference 142, a decimation/compression module 144, a decompression PDM module 146, and a pre-amplifier 148.

The function of the low pass filter 140 removes higher frequency from the charge pump. The function of the reference 142 is a voltage or other reference used by components within the system as a convenient reference value. The function of the decimation/compression module 144 is to minimize the buffer size take the data or compress and then store it. The function of the decompression PDM module 146 is pulls the data apart for the control module. The function of the pre-amplifier 148 is bringing the sensor output signal to a usable voltage level.

The components identified by the label 100 in FIG. 1A and FIG. 1B may be disposed on a single application specific integrated circuit (ASIC) or other integrated device. However, the charge pump 101 is not disposed on the ASIC 160 in FIG. 1A and is on the ASIC in the system of FIG. 1B These elements may or may not be disposed on the ASIC in a particular implementation. It will be appreciated that the ASIC may have other functions such as signal processing functions.

Referring now to FIG. 2, FIG. 3, FIG. 4, and FIG. 5, a microphone (e.g., the microphone 100 of FIG. 1) operates in a standard performance mode and a sensing mode, and these are determined by the clock frequency. In standard performance mode, the microphone acts as a standard microphone in which it clocks out data as received. The frequency range required to cause the microphone to operate in the standard mode may be defined or specified in the datasheet for the part-in-question or otherwise supplied by the manufacturer of the microphone.

In sensing mode, the output of the microphone is tri-stated and an internal clock is applied to the sensing circuit. Once the AAD module triggers (e.g., sends a trigger signal indicating an acoustic event has occurred), the microphone transmits buffered PDM data on the microphone data pin (e.g., data pin 126) synchronized with the internal clock (e.g. a 512 kHz clock). This internal clock will be supplied to the select pin (e.g., select pin 124) as an output during this mode. In this mode, the data will be valid on the rising edge of the internally generated clock (output on the select pin). This operation assures compatibility with existing I2S-comaptible hardware blocks. The clock pin (e.g., clock pin 122) and the data pin (e.g., data pin 126) will stop outputting data a set time after activity is no longer detected. The frequency for this mode is defined in the datasheet for the part in question. In other example, the interface is compatible with the PDM protocol or the $I^2C$ protocol. Other examples are possible.

The operation of the microphone described above is shown in FIG. 2. The select pin (e.g., select pin 124) is the top line, the data pin (e.g., data pin 126) is the second line from the top, and the clock pin (e.g., clock pin 122) is the bottom line on the graph. It can be seen that once acoustic activity is detected, data is transmitted on the rising edge of the internal clock. As mentioned, this operation assures compatibility with existing I2S-comaptible hardware blocks.

For compatibility to the DMIC-compliant interfaces in sensing mode, the clock pin (e.g., clock pin 122) can be driven to clock out the microphone data. The clock must meet the sensing mode requirements for frequency (e.g., 512 kHz). When an external clock signal is detected on the clock pin (e.g., clock pin 122), the data driven on the data pin (e.g., data pin 126) is synchronized with the external clock within two cycles, in one example. Other examples are possible. In this mode, the external clock is removed when activity is no longer detected for the microphone to return to lowest power mode. Activity detection in this mode may use the select pin (e.g., select pin 124) to determine if activity is no longer sensed. Other pins may also be used.

Figure 3:
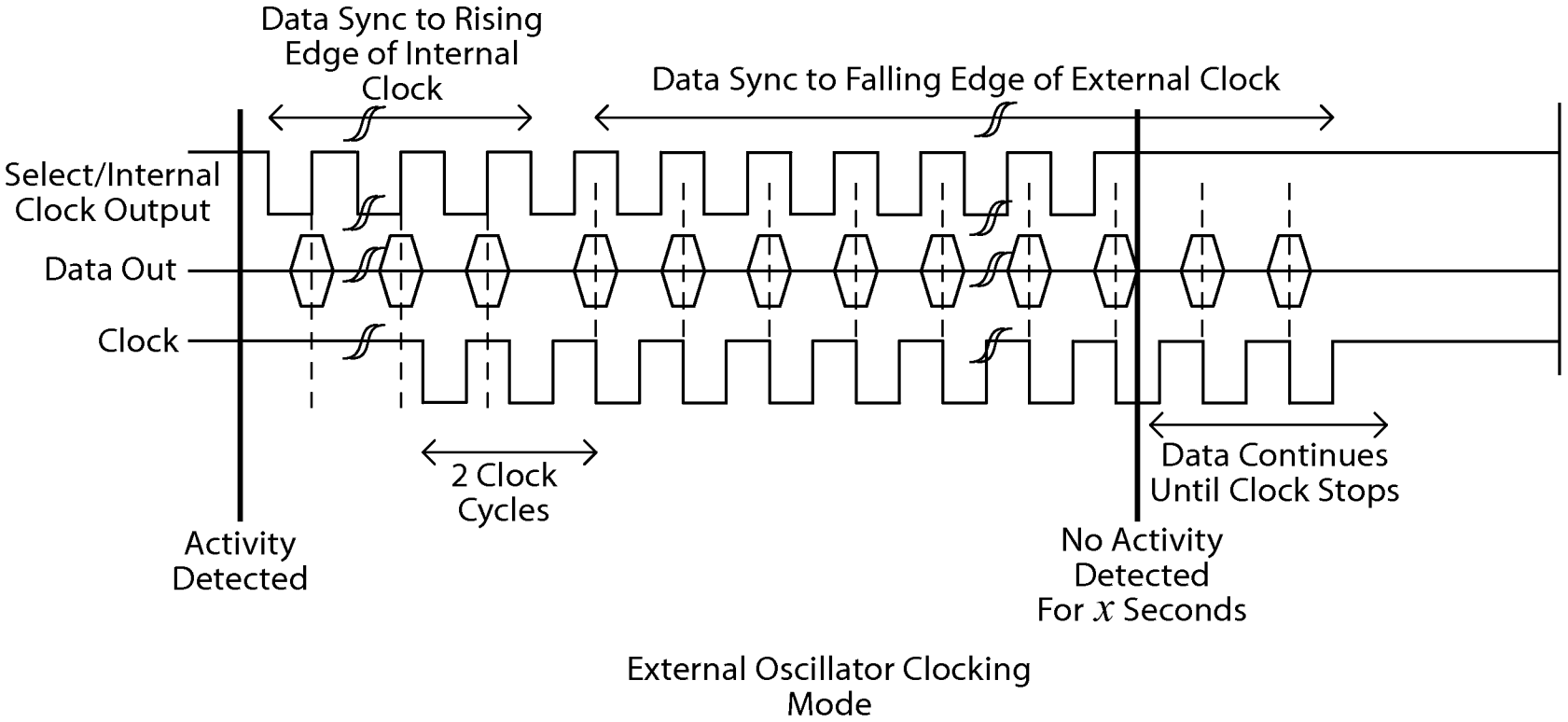
FIG. 3 comprises a timing diagram showing another aspect of the operation of the system of FIG. 1 according to various embodiments of the present invention.

This operation is shown in FIG. 3. The select pin (e.g., select pin 124) is the top line, the data pin (e.g., data pin 126) is the second line from the top, and the clock pin (e.g., clock pin 122) is the bottom line on the graph. It can be seen that once acoustic activity is detected, the data driven on the data pin (e.g., data pin 126) is synchronized with the external clock within two cycles, in one example. Other examples are possible. Data is synchronized on the falling edge of the external clock. Data can be synchronized using other clock edges as well. Further, the external clock is removed when activity is no longer detected for the microphone to return to lowest power mode.

Figure 4:
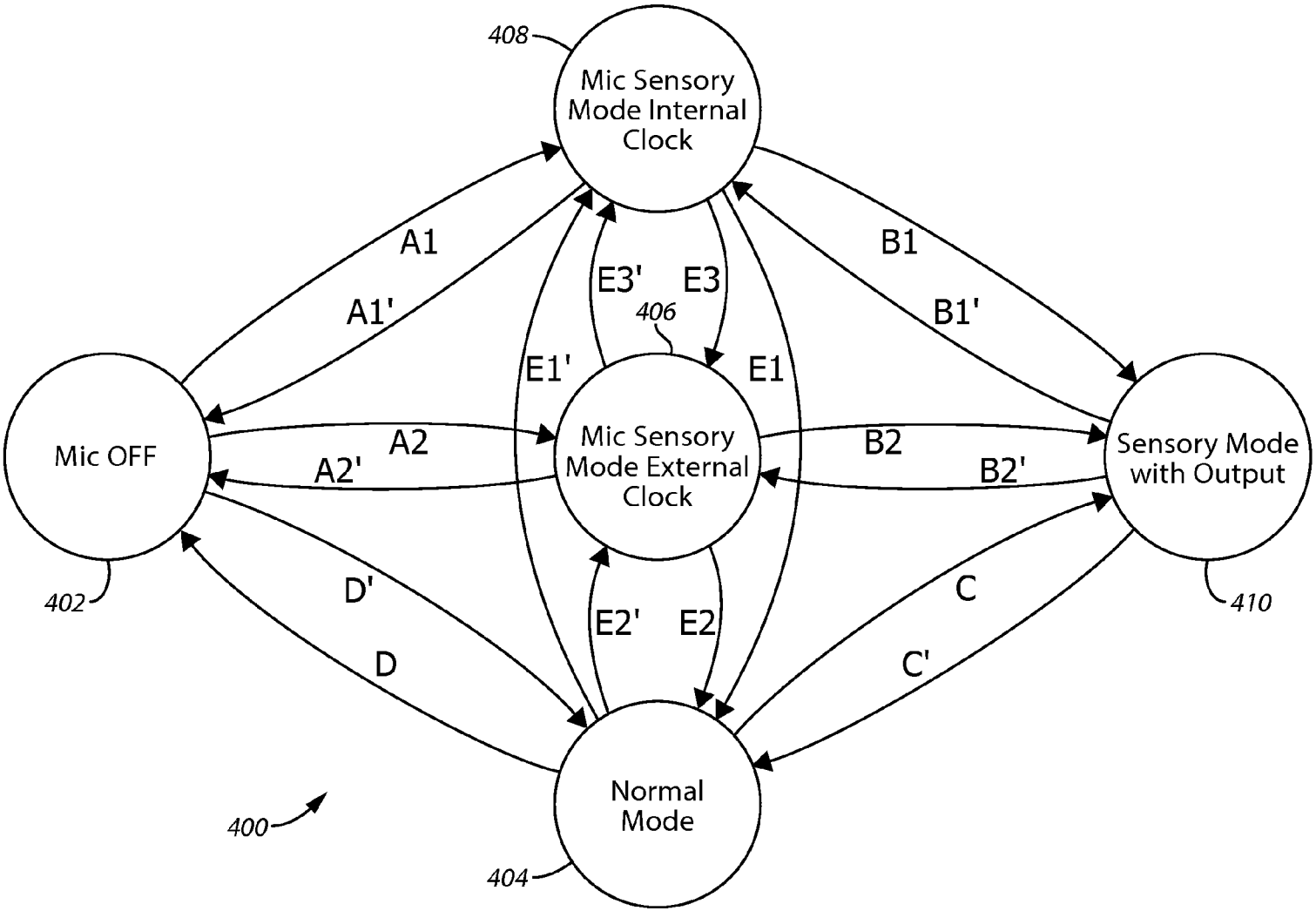
FIG. 4 comprises a state transition diagram showing states of operation of the system of FIG. 1 according to various embodiments of the present invention.

Referring now to FIGS. 4 and 5, a state transition diagram 400 (FIG. 4) and transition condition table 500 (FIG. 5) are described. The various transitions listed in FIG. 4 occur under the conditions listed in the table of FIG. 5. For instance, transition A1 occurs when Vdd is applied and no clock is present on the clock input pin. It will be understood that the table of FIG. 5 gives frequency values (which are approximate) and that other frequency values are possible. The term "OTP" means one time programming.

The state transition diagram of FIG. 4 includes a microphone off state 402, a normal mode state 404, a microphone sensing mode with external clock state 406, a microphone sensing mode internal clock state 408 and a sensing mode with output state 410.

Figure 2:
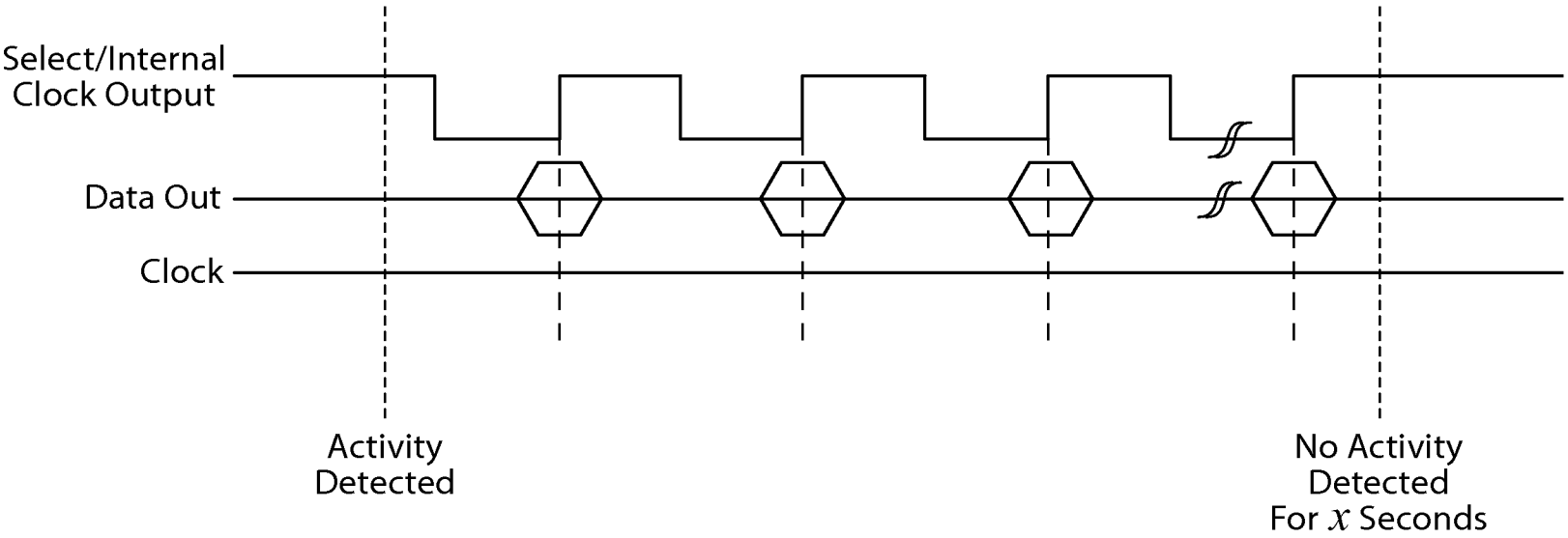
FIG. 2 comprises a timing diagram showing one aspect of the operation of the system of FIG. 1 according to various embodiments of the present invention.

The microphone off state 402 is where the microphone 400 is deactivated. The normal mode state 404 is the state during the normal operating mode when the external clock is being applied (where the external clock is within a predetermined range). The microphone sensing mode with external clock state 406 is when the mode is switching to the external clock as shown in FIG. 3. The microphone sensing mode internal clock state 408 is when no external clock is being used as shown in FIG. 2. The sensing mode with output state 410 is when no external clock is being used and where data is being output also as shown in FIG. 2.

As mentioned, transitions between these states are based on and triggered by events. To take one example, if the microphone is operating in normal operating state 404 (e.g., at a clock rate higher than 512 kHz) and the control module detects the clock pin is approximately 512 kHz, then control goes to the microphone sensing mode with external clock state 406. In the external clock state 406, when the control module then detects no clock on the clock pin, control goes to the microphone sensing mode internal clock state 408. When in the microphone sensing mode internal clock state 408, and an acoustic event is detected, control goes to the sensing mode with output state 410. When in the sensing mode with output state 410, a clock of greater than approximately 1 MHz may cause control to return to state 404. The clock may be less than 1 MHz (e.g., the same frequency as the internal oscillator) and is used synchronized data being output from the microphone to an external processor. No acoustic activity for an OTP programmed amount of time, on the other hand, causes control to return to state 406.

It will be appreciated that the other events specified in FIG. 5 will cause transitions between the states as shown in the state transition diagram of FIG. 4.

Figure 6:
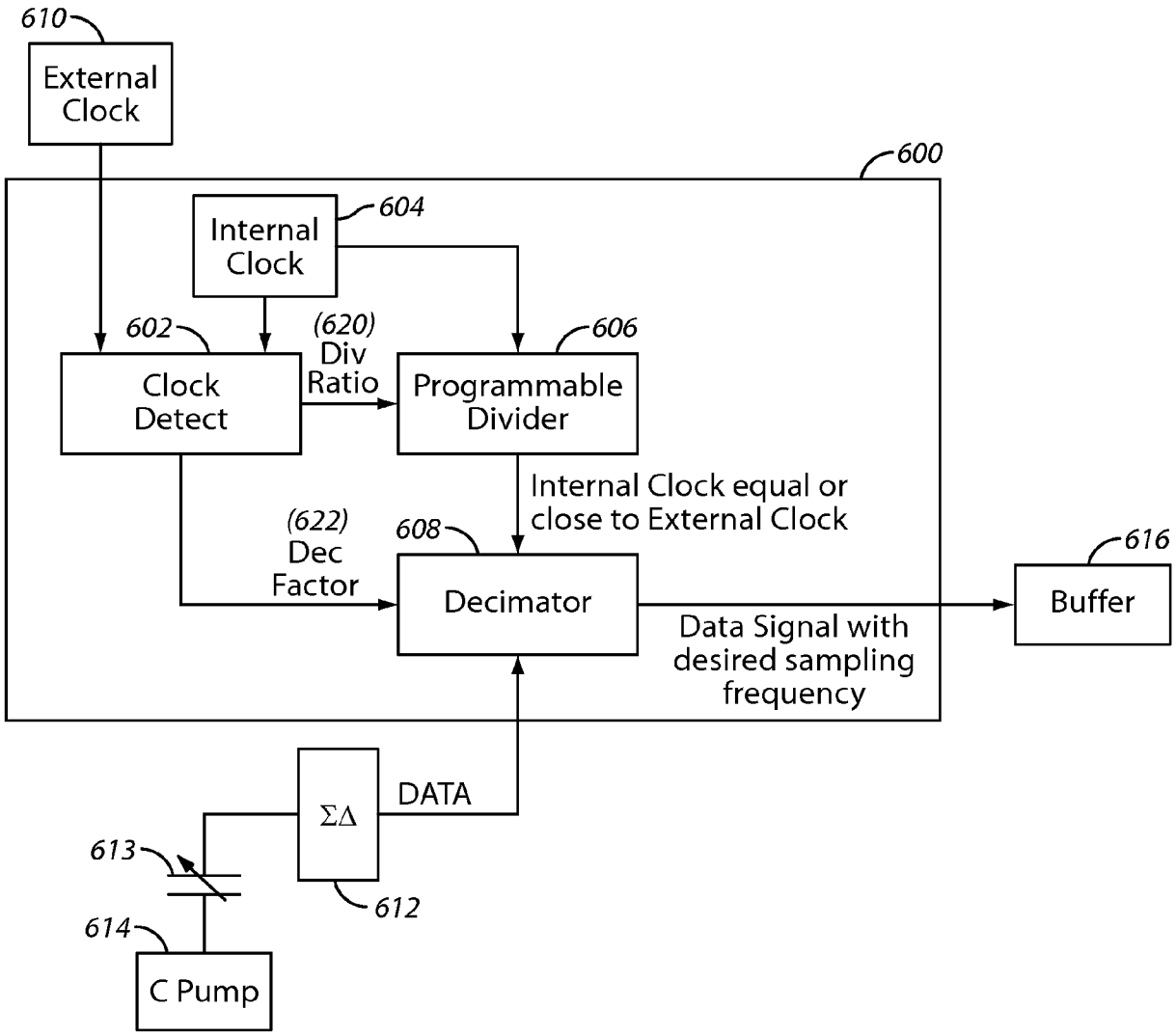
FIG. 6 comprises a block diagram of one example of a clock detector according to various embodiments of the present invention.

Referring now to FIG. 6, the clocking module 600 includes a clock detect block 602, an internal clock 604, a programmable divider 606, and a decimator 608. An external clock 610 couples to the clock detect block 602. A charge pump 614 couples to a microphone 613, which couples to a sigma delta converter 612, which couples to the decimator 608. The decimator 608 couples to a buffer 616.

It will be appreciated that the clocking module 600 may be the clock detector module 104 of FIG. 1A or 1B in one example. It will also be understood that the elements of the clocking module may be implemented using any combination of hardware and/or software elements. In one example, the elements may be implemented using computer instructions implemented on any type of processing device (e.g., a microprocessor).

The clock detect block 602 receives the external clock and calculates a division ratio 620 and a decimation factor 622 as described below. The internal clock 604 provides a high frequency signal while the external clock 610 provides a lower frequency signal. The programmable divider 606 reduces the frequency of the internal clock 604. The decimator 608 converts 1 bit PDM data to PCM data with a frequency determined by the decimation factor. The decimator 608 may include one or more filters.

The charge pump 614 provides voltage for the microphone 613. The microphone 613 may be MEMS sensors, piezoelectric sensor, or any other type of sensing device. The sigma delta converter 612 converts the analog signal from the microphone 614 into a digital signal for use by the decimator 608.

In one example of the operation of the clocking module 600, the internal clock 604 provides a 12.288 MHz internal clock signal. The clock detect block 602 in one aspect contains a counter that counts internal clock pulses. When a signal from the external clock 610 is applied to the clock detect block 602, the counter will count how many internal clocks pulses were within an external clock pulse. The internal clock 604 must be higher frequency than the external clock 610. In this example, the external clock 610 is a 512 kHz clock and is applied to the external clock pin of the clocking module 600.

The clock detect block 602 now counts how many internal clock pulses there are within one external clock cycle. In this case, 12,288,000/512,000=24 clocks. Once it is confirmed that the divide down ratio is, in fact, 24, the programmable divider 606 is programmed with the number 24. At this point, the internal clock signal is now 512,000 Hz. This internal clock signal as modified by the programmable divider 606 will clock the decimator 608.

Based on the desired output data rate (the predetermined desired sampling frequency), and to take one example, 16 kHz data at 16 bits (however, it will be appreciated that this could be any other frequency and bit length) is needed to feed the next stage of the system at the buffer 616.

The clock detect block 602 take the internal clock signal and the predetermined desired sampling frequency to determine the decimation factor (ratio) 622 of the decimator 608. In one example, a 16,000 Hz sample rate is required, and the clock detect block 602 will divide 512,000/16,000 to get a decimation factor of 32.

The clock detect block 602 programs the decimator 608 with a 32× decimation factor (ratio) 622 and adjust filters within the decimator 608 to provide data at a 16 kHz rate.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A method in a microphone, the method comprising:

decimating data obtained from an electrical signal representative of acoustic energy using a decimator;

determining whether voice activity is present in the electrical signal while buffering the decimated data and while clocking the microphone with an internal clock signal;

receiving an external clock signal after determining the likely presence of voice activity;

applying a decimation factor to the decimator after receiving the external clock signal, the decimation factor based on a specified sampling frequency and a signal having a frequency that is the same as, or substantially the same as, a frequency of the external clock signal.

2. The method claim 1, further comprising:

clocking the microphone with the external clock signal after receiving the external clock signal; and applying the decimation factor to the decimator before buffering decimated data after receiving the external clock signal.

3. The method of claim 1, further comprising determining the decimation factor by dividing the frequency of the signal that is the same as, or substantially the same as, the frequency of the external clock signal by the specified sampling frequency, wherein the specified sampling frequency is determined by a buffer in which decimated data is buffered.

4. The method of claim 3, further comprising:

reducing a frequency of the internal clock signal by a factor based on an approximate ratio of a frequency of the internal clock signal to a frequency of the external clock signal; and computing the decimation factor by dividing the reduced frequency of the internal clock signal by the specified sampling frequency.

5. The method of claim 1, reducing a frequency of the internal clock signal by a factor based on an approximate ratio of a frequency of the internal clock signal to a frequency of the external clock signal.

6. The method claim 1, further comprising:

decimating data by converting pulse density modulated (PDM) format data to pulse code modulated (PCM) format data; and buffering the PCM data.

7. The method claim 1 further comprising generating the electrical signal representative of acoustic energy based on acoustic energy sensed by an acoustic sensor.

8. The method claim 1, receiving the external clock signal at the microphone in response to providing an interrupt signal from the microphone after determining that voice activity is likely present.

9. The method of claim 1, further comprising:

decimating data obtained from the electrical signal representative of acoustic energy at a first decimation rate based on a first decimation factor while clocking the microphone with the internal clock signal before receiving the external clock signal;

decimating data obtained from the electrical signal representative of acoustic energy at a second decimation rate based on a second decimation factor after receiving the external clock signal; and the second decimation factor based on a specified sampling frequency and a signal having a frequency that is the same as, or substantially the same as, a frequency of the external clock signal.

10. A microphone having an internal clock signal, the microphone comprising:

an analog-to-digital (A/D) converter having an input and an output, the A/D converter configured to convert an electrical signal representative of acoustic energy to digital data;

a decimator interconnecting an output of the A/D converter and a buffer, wherein the buffer is configured to buffer decimated data representative of the electrical signal;

a voice activity detector (VAD) coupled to the output of the A/D converter, wherein the VAD is configured to determine whether voice activity is likely present in the electrical signal while decimated data is buffered in the buffer, the decimator has a decimation factor based on a specified sampling frequency and a signal having a frequency that is the same as, or substantially the same as, a frequency of an external clock signal present at an external-device interface of the microphone.

11. The microphone of claim 10, wherein the microphone is clocked with the internal clock signal before the external clock signal is present at the external-device interface, wherein the microphone is clocked with the external clock signal after the external clock signal is present at the external-device interface, and wherein the decimator is configured to use the decimation factor when buffering decimated data after the external clock signal is present at the external-device interface.

12. The microphone of claim 10, the decimation factor is a ratio of the frequency of the signal that is the same as, or substantially the same as, the frequency of the external clock signal and the specified sampling frequency, wherein the specified sampling frequency is determined by the buffer.

13. The microphone of claim 12, wherein a frequency of the internal clock signal is reduced by a factor based on an approximate ratio of a frequency of the internal clock signal and a frequency of the external clock signal, and wherein the decimation factor is a ratio of the reduced frequency of the internal clock signal and the specified sampling frequency.

14. The microphone of claim 10, wherein a frequency of the internal clock signal is reduced by a factor based on an approximate ratio of a frequency of the internal clock signal and a frequency of the external clock signal.

15. The microphone claim 10, wherein the decimator is configured to convert pulse density modulated (PDM) format data to pulse code modulated (PCM) format data.

16. The microphone claim 10, further comprising an acoustic sensor having an output with the electrical signal representative of acoustic energy.

17. The microphone of claim 10, wherein the external clock signal present at the external-device interface in response to an interrupt signal provided at the external-device interface after the microphone determines that voice activity is likely present.

18. The microphone of claim 10, wherein the decimator has a first decimation rate based on a first decimation factor when the microphone is clocked by the internal clock signal, and wherein the decimator has a second decimation rate based on a second decimation factor when the microphone is clocked by the external clock signal.

19. The microphone of claim 18, wherein the decimator has the first decimation rate when the microphone is initially clocked by the internal clock signal, wherein the decimator has the second decimation rate after the microphone is clocked by the external clock signal, and wherein the decimator continues to have the second decimation rate after the microphone transitions from being clocked by the external clock signal to being clocked by the internal clock signal.

20. A microphone comprising:

an analog-to-digital (A/D) converter having an input and an output, the A/D converter configured to convert an electrical signal representative of acoustic energy to digital data;

a decimator interconnecting an output of the A/D converter and a buffer, wherein the buffer is configured to buffer decimated data representative of the electrical signal;

a voice activity detector (VAD) coupled to the output of the A/D converter, wherein the VAD is configured to determine whether voice activity is likely present in the electrical signal while decimated data is buffered in the buffer, the microphone clocked by an internal clock signal during a first time period and the microphone clocked by an external clock signal during a second time period that occurs after the VAD determines that voice activity is likely present, the decimator having a first decimation rate based on a first decimation factor during the first time period, and the decimator having a second decimation rate based on a second decimation factor during the second time period, the second decimation factor based on a specified sampling frequency and a signal having a frequency that is the same as, or substantially the same as, a frequency of an external clock signal present at an external-device interface of the microphone.

21. The microphone of claim 20, wherein the second decimation factor is a ratio of the frequency of the signal that is the same as, or substantially the same as, the frequency of the external clock signal and the specified sampling frequency, wherein the specified sampling frequency is specified by the buffer.

22. The microphone of claim 21, wherein the second decimation factor is a ratio of a reduced frequency of the internal clock signal and the specified sampling frequency.

23. The microphone of claim 20, wherein a frequency of the internal clock signal is reduced by a factor based on an approximate ratio of a frequency of the internal clock signal and a frequency of the external clock signal.

* * * * *